United States Patent [19]

Dallaire

[11] 4,058,324

[45] Nov. 15, 1977

[54] ROLLER SKATE WITH MANEUVERABILITY ADJUSTMENTS

[76] Inventor: Lucien Dallaire, 165 - 35th St., East, St. Georges de Beauce, Quebec, Canada, G5Y 2P7

[21] Appl. No.: 653,652

[22] Filed: Jan. 30, 1976

[30] Foreign Application Priority Data

Feb. 5, 1975 Canada ..... 219451

[51] Int. Cl.[2] ..... A63C 17/06

[52] U.S. Cl. ..... 280/11.22; 280/11.3

[58] Field of Search ..... 280/11.22, 11.23, 11.26, 280/11.3, 11.27, 11.1 ET, 11.1 R, 7.13; 301/5.3, 5.7

[56] References Cited

U.S. PATENT DOCUMENTS

| | | | |
|---|---|---|---|
| 1,355,680 | 10/1920 | McLean | 280/11.12 |
| 1,700,058 | 1/1929 | Katurby | 280/11.23 |
| 1,960,234 | 5/1934 | Eckels | 280/11.1 ET |
| 2,035,897 | 3/1936 | Kosanovich | 280/7.13 |
| 2,145,219 | 1/1939 | Burton | 280/11.22 |
| 2,220,557 | 11/1940 | User | 280/11.22 |
| 3,387,852 | 6/1968 | De Sarro | 280/11.22 |

FOREIGN PATENT DOCUMENTS

| | | | |
|---|---|---|---|
| 411,405 | 6/1910 | France | 280/11.22 |

*Primary Examiner*—Joseph F. Peters, Jr.
*Assistant Examiner*—David M. Mitchell

[57] ABSTRACT

A roller skate adapted to be secured to a given shoe and characterized by including an intermediate roller of adjustable height relative to the other rollers to produce selectable longitudinal curvature and maneuvering possibilities comparable to those of the ice skate, and also characterized by including a roller carrier which is readily replaceable and longitudinally and laterally adjustable for similar adjustments of all the rollers as a whole. This roller skate includes brackets to adjustably and removably attach the roller carrier relative to a shoe. The roller carrier extends longitudinally of the shoe and the intermediate roller is positioned intermediate the other rollers longitudinally of the roller carrier.

3 Claims, 6 Drawing Figures

ROLLER SKATE WITH MANEUVERABILITY ADJUSTMENTS

This invention relates to a roller skate.

The roller skates which have been proposed so far essentially include rollers which are in fixed height relationship relative to each other and in fixed spaced-apart relationship when secured to a given shoe. Besides, the prior roller skates include each a specific set of rollers which is not replaceable relative to the support thereof and, besides, is neither laterally nor longitudinally adjustable as a whole relative to such support. Consequently, the maneuvering possibilities of any roller skate of the prior art is preset and inherent to the fixed spatial relationship between the rollers and between the set of rollers as a whole and the operatively associated shoe.

It is a general object of the present invention to provide a roller skate, the maneuvering possibilities of which may be adjusted while remaining associated or attached to a given shoe.

It is another general object of the present invention to provide a roller skate wherein the rollers are spatially adjustable relative to each other to adjustably simulate the longitudinal curvature of the blade of an ice skate and to thus provide a roller skate with maneuvering possibilities of an ice skate.

It is a more specific object of the present invention to provide a roller skate wherein the rollers are spatially adjustable relative one to another, and as a whole both laterally and longitudinally relative to the shoe to which the roller skate is secured.

The above and other objects and advantages of the present invention will be better understood with the following detailed description of a preferred embodiment thereof, which is illustrated, by way of example, in the accompanying drawing, wherein.

Figure 1:
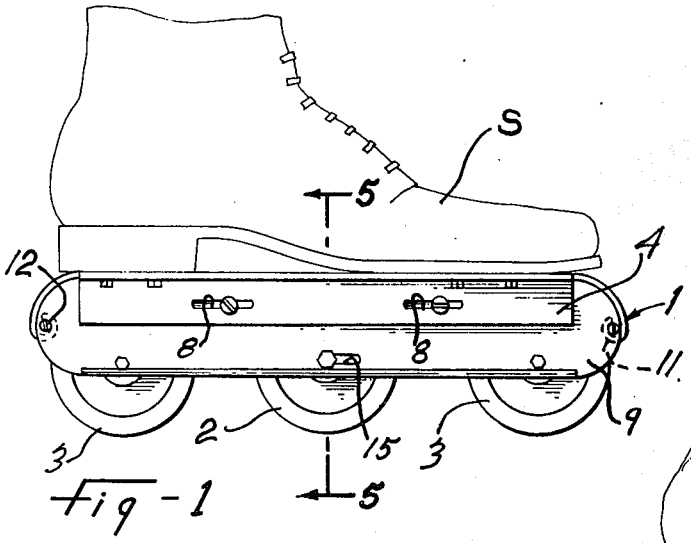
FIG. 1 is a lateral elevation view of the roller skate according to the present invention operatively secured to a shoe.
Figure 2:
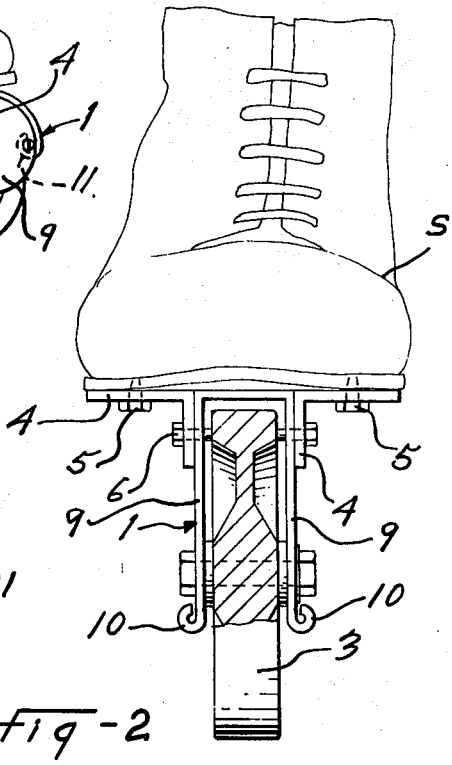
FIG. 2 is a front view as seen from the right in FIG. 1 with parts broken away.
Figure 3:
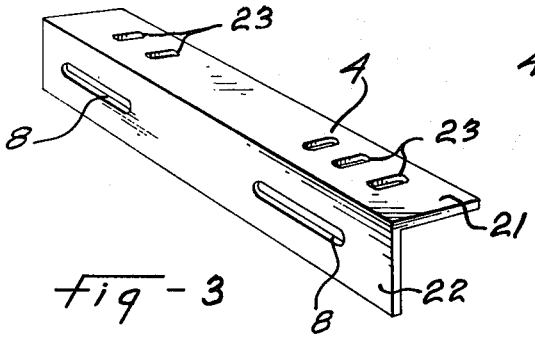
FIG. 3 is a perspective view of an angle member providing connection to the shoe.
Figure 4:
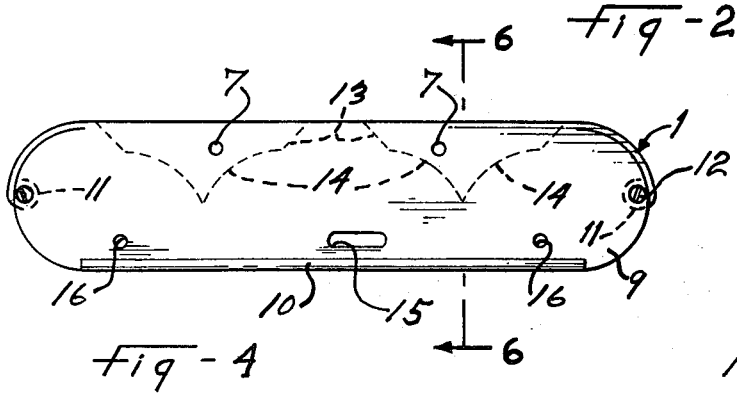
FIG. 4 is a side elevation view of a casing forming part of the roller skate, as may be seen in FIGS. 1 and 2.
Figure 5:
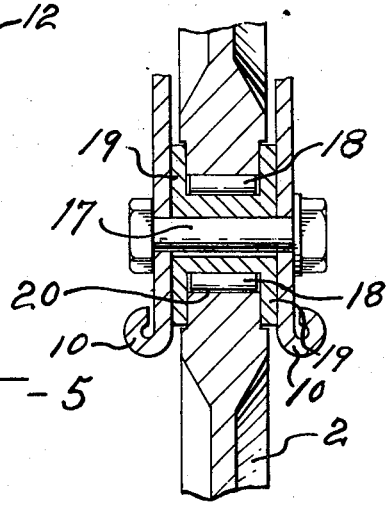
Figure 6:
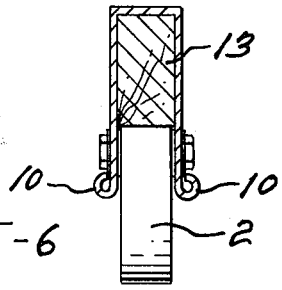

FIG. 5 is a transverse cross-section through the intermediate roller, as seen along line 5—5 in FIG. 1; and FIG. 6 is a transverse cross-section as seen along line 6—6 in FIG. 4 with the rollers attached to the casing The illustrated roller skate includes a roller carrier 1 carrying or supporting an intermediate roller 2 and a pair of end rollers 3. Angle brackets 4 secure the roller carrier 1 to the shoe S by screws 5 or other suitable expedients, such as rivets, and by bolts 6 projecting transversely through apertures 7 in the roller carrier 1 and through slots 8 in the angle brackets.

The roller carrier 1 is elongated and extends longitudinally to the shoe S. The roller carrier is constituted of a sheet metal casing including a pair of laterally spaced-apart sides 9 and closed ends forming an open bottom having a beaded edge around the bottom opening of the casing defined by the beaded edge portions 10 of the lateral sides 9 and the beaded edge sections 11 of the ends of the casing. The beaded edge sections 11 serve to screw the sides 9 to the ends of the casing, as shown by the screws 12.

A pair of spacer blocks 13 are secured in the casing to maintain the sides 9 thereof in fixed spaced-apart relationship. As shown in FIG. 4, each block 13 is concavely profiled at 14 to form a pointed portion which nips between two adjacent rollers 2 and 3. The opposite lateral sides 9 of the casing, or roller carrier 1, are formed with each a slot 15 extending longitudinally of the roller carrier and transversely registering with the corresponding slot 15 of the opposite side 9. Preferably, the slots 15 extend forwardly from the mid-point between the axes of the end rollers 3; that is, relative to the holes 16 in the sides 9 to mount the rollers 3.

The rollers 3 may be of conventional construction and are rotatably secured to the sides 9 of the roller carrier 1 by appropriate bolts engaged in the holes 16. The intermediate roller 2 is rotatably secured to the sides 9 by a bolt or pin 17 extending through the longitudinal slots 15. The roller 2 is provided with a central bearing having needles 18, but it could be a bearing of any other type having an inner race 19 in the form of a conventional eccentric sleeve or bushing. The latter includes a central aperture 20 of slightly larger diameter than the bolt 17 for passage of the bolt 17. Up and down adjustment of roller 2 relative to the bolt 17 is obtained by rotating sleeve 19 to the desired extent. Thus, the tightening of the bolt 17 causes the sides 9 to clamp the inner race 19 and thus hold the roller 2 in the selected position, both upwardly and longitudinally, relative to the roller carrier 1. Consequently, the height of the roller 2 may be adjustably set relative to the other rollers 3, such that the ground contact point of the intermediate roller 2 is selectively set lower than the ground contact points defined by the other rollers, Thus, a longitudinal curvature is defined through these contact points of different heights. This imitates the curvature given to the blade of an ice skate. As a result, the maneuvering possibilities due to such curvature are also gained for the roller skate with the additional benefit of allowing adjustable setting of the curvature to vary the maneuvering possibilities.

The angle brackets 4 are positioned on opposite sides of the roller carrier 1 and define connections to attach the latter against the bottom of a shoe. Each angle bracket 4 includes an operatively upright flange 21 and horizontal flange 22. The horizontal flange 22 is provided with transversely extending slots 23 through which the screws 5, or the like, are inserted to secure the brackets 4 to the shoe. Thus, it may readily be understood that the angle brackets 4 may be adjustably shifted laterally due to the slots 23 and, thus, they allow similar shifting of the roller carrier 1 and bodily lateral adjustment of the rollers 2 and 3.

The bolts 6 are longitudinally adjustable in the slots 8 and thus allow longitudinal adjustment of the roller carrier 1 and bodily adjustable setting of the rollers longitudinally of the shoe S. The bolts 6 also allow bodily removal and replacement of the rollers without interfering with the connection to the shoe.

It must be noted that there are essentially at least three rollers to provide an intermediate roller 2. Preferably, there should be an odd number of rollers, such that the roller in the middle constitutes the intermediate roller. If, for instance, five rollers are used, the latter will be smaller and this would provide a different performance than the afore-described three-roller carrier unit. With the removability feature of the roller carrier 1, this allows any possibility of changing the maneuvering possibilities by changing from a three-roller carrier unit to a five-roller carrier unit.

It must also be noted that the afore-described lateral and longitudinal adjustment features also allow to vary the maneuvering possibilities, since the relative position of the rollers as a whole relative to the shoe is also a factor affecting the maneuverability.

It must also be noted that the afore-described roller skate as a whole, except pieces where metal is absolutely necessary in regard of solidity and resistance, as well as maneuverability, may be built with moulded plastic material or fiberglass, such as to offer sufficient rigidity and to preserve the principles and characteristics of the afore-described roller skate.

It must also be noted that all or any of the rollers, and not only the intermediate one, may be provided with a central bearing having needles or any other type of bearing having an inner race in the form of a sleeve as specified concerning the intermediate roller.

I claim:

1. A roller skate adapted to be mounted against the bottom of a shoe, comprising an elongated roller carrier in the form of an open bottom casing defining a pair of laterally spaced-apart upright longitudinal sides, a pair of lateral members extending along the sides of said roller carrier and having upper horizontal flanges provided with transverse slots, means extending through said transverse slots and into the bottom of a shoe to secure said lateral members to said shoe while allowing lateral adjustment of the same with respect to said shoe, said lateral members including vertically extending portions applied against the opposite sides of said elongated roller carrier having longitudinally extending slots, bolt means projecting through said longitudinally extending slots and arranged to adjustably position and secure the roller carrier to said lateral members, an odd number of rollers rotatably carried by the elongated roller carrier and extending between the sides of the latter, one of said rollers being a middle roller, means to adjustably set said middle roller up and down relative to the other rollers, said means including an excentric bushing on which said middle roller is rotatable, said excentric bushing mounted between the sides of said roller carrier and a bolt extending through holes of the sides of said roller carrier and through said central bushing and supporting said bushing and roller and tightening the sides of said roller carrier against said bushing to prevent rotation of the latter.

2. A roller skate as claimed in claim 1, wherein the holes in said sides to receive said last-named bolt are in the form of slots extending longitudinally of the roller carrier to adjustably support said last-named bolt, whereby the longitudinal position of said middle roller can be adjusted with respect to the other rollers.

3. A roller skate as claimed in claim 1, wherein said elongated casing is made of sheet metal with beaded edges around the open bottom and further including spaced blocks mounted between the spaced-apart sides and concavely profiled to nip between the rollers of the pair of adjacent rolers.

* * * * *